US007473005B2

(12) United States Patent
O'Brien

(10) Patent No.: US 7,473,005 B2
(45) Date of Patent: Jan. 6, 2009

(54) COMBINED INSULATION CAPABLE AND NON-INSULATION CAPABLE RECESSED LIGHTING ASSEMBLY

(76) Inventor: Aaron O'Brien, 7801 Hohman Ave., Munster, IN (US) 46321

( * ) Notice: Subject to any disclaimer, the term of this patent is extended or adjusted under 35 U.S.C. 154(b) by 242 days.

(21) Appl. No.: 11/383,602

(22) Filed: May 16, 2006

(65) Prior Publication Data

US 2007/0268708 A1 Nov. 22, 2007

(51) Int. Cl.
*F21S 8/00* (2006.01)

(52) U.S. Cl. ..... 362/148; 362/147; 362/150; 362/276; 362/294; 362/364; 362/365; 362/404

(58) Field of Classification Search ..... 362/147, 362/148, 150, 276, 294, 364, 365, 373, 404, 362/802

See application file for complete search history.

(56) References Cited

U.S. PATENT DOCUMENTS 5,374,812 A * 12/1994 Chan et al. ..... 220/3.6
5,758,959 A * 6/1998 Sieczkowski ..... 362/365
6,089,732 A * 7/2000 Wright et al. ..... 362/364

* cited by examiner

*Primary Examiner*—Sandra L. O'Shea
*Assistant Examiner*—Meghan K. Dunwiddie

(57) ABSTRACT

A light assembly is provided for installation in one of an insulation capable (IC) environment and a non-insulation capable (non-IC) environment. The light assembly comprises a light fixture and a label. The light fixture includes a housing having an open end and a wall visible through the open end, the wall defining an aperture having a size sufficient for determining whether insulation is within a predetermined distance of the light fixture. The label includes an indicia signaling a user to use the aperture to make a determination whether insulation is within the predetermined distance of the light fixture and to make a lamp selection based on the determination.

33 Claims, 11 Drawing Sheets

COMBINED INSULATION CAPABLE AND NON-INSULATION CAPABLE RECESSED LIGHTING ASSEMBLY

FIELD

The present invention relates, generally, to a lighting assembly and, more particularly, to a recessed lighting assembly configured for installations in both insulation capable and non-insulation capable environments.

BACKGROUND

In current residential and commercial buildings, recessed lighting assemblies or fixtures are typically installed in a space between the ceiling joists or beams and above an existing ceiling substrate, i.e., drywall, plaster, wood, planking, etc. Fiberglass, cellulose, or other thermal insulation material is also typically installed between the ceiling joists so as to inhibit a flow of heat from living spaces through the ceiling to the attic space. If the thermal insulation material is permitted to encroach upon the recessed light fixture, there is a potential for heat entrapment and excessive heat build up within the recessed lighting fixture which could result in damage to the wiring or to the surrounding combustible materials used in the building construction.

In order to avoid heat entrapment and excessive heat build up, thermal insulation is typically not installed in proximity of enclosures, housing or cans, of the recessed fixtures, unless the recessed fixture is approved for use in an insulation environment in accordance with requirements set forth by a compliance agency, such as the by Underwriters Laboratories (UL). For example, the UL1598 standard provides operating requirements for recessed lighting fixtures to be labeled as insulation capable ("IC") or non-insulation capable (commonly referred to as either "non-IC" or "TC").

The UL 1598 standard specifies that an IC labeled fixture may be in contact with the surrounding insulation or be within three inches from the surrounding insulation, but can not operate if an external surface temperature exceeds 90° Celsius (C.). Hence, when installed in an insulation environment, the IC labeled fixture typically includes a thermal protector device that shuts off or cycles power when the corresponding surface temperature exceeds 90° C.

Conversely, the UL 1598 standard specifies that non-IC labeled fixture be positioned at least three inches from the surrounding insulation, and can not operate if the external surface temperature of the fixture exceeds 150° Celsius (C.). Accordingly, the conventional non-IC labeled fixture includes a thermal protector device that shuts off or cycle power to the fixture when the fixture external surface temperature exceeds 150° C.

In order to satisfy or meet these required UL 1598 standards, most lighting manufacturers have typically produced two kinds of recessed lighting fixtures for installation in IC or non-IC environments, respectively. As such, fixture retailers need to stock both kinds of recessed fixtures to meet the demands of installers or users. However, these dual manufacturing and stocking situations can lead to a substantial amount of wasted materials and expenses.

Other lighting manufacturers have produced universal housings for lighting fixtures which may be installed and operated in both IC and non-IC environments. These universal housings were provided with indicia enabling installers or users to select appropriate trim and lamp wattage for use in IC and non-IC environments. However, after installation in the ceiling, end users may be unable to readily determine whether the housing fixtures are installed in IC or non-IC environments as proper installation labels may be missing or no longer visible to the users.

Therefore, a need exists for a recessed lighting assembly that overcomes the problems noted above and others previously experienced for operating in both IC and non-IC environments. These and other needs will become apparent to those skilled in the art after reading the present specification.

SUMMARY

The foregoing problems are solved and a technical advance is achieved by the present embodiments. A light assembly is provided for installation in one of an insulation capable (IC) environment and a non-insulation capable (non-IC) environment. The light assembly comprises a light fixture and a label. The light fixture includes a housing having an open end and a wall visible through the open end. The wall defines an aperture having a size sufficient for determining whether insulation is within a predetermined distance of the light fixture. The label includes indicia signaling a user to use the aperture to make a determination whether insulation is within the predetermined distance of the light fixture and to make a lamp selection based on the determination.

In another aspect, a light assembly is provided for installation in one of an IC environment and a non-IC environment. The light assembly includes a pan support, a junction box, a light fixture, and a thermal protecting unit. The light fixture includes a housing, and a label. The housing is mounted on the pan support and connected to the junction box. The housing has an open end and a wall visible through the open end. The wall defines an aperture having a size sufficient for determining whether insulation is within a predetermined distance of the light fixture. The label includes a cut-out aligned with the defined aperture, and an indicia signaling a user to use the aperture to make a determination whether insulation is within the predetermined distance of the light fixture and to make a lamp selection based on the determination. The thermal protector unit is affixed to the housing, and operable to sense a temperature near an internal surface of the housing and to interrupt power to a lamp installed in the housing when the sensed temperature reaches a predetermined value.

Articles of manufacture consistent with the present embodiments also provide a trim for mating to a light fixture, which is adapted to be used with the light fixture installed in one of an IC environment and a non-IC environment. The trim comprises a flange adapted to cover a gap between the light fixture and a ceiling in which the light fixture is installed, and a label disposed on the flange and marked with instructions or indicia identifying lamp types and wattages that can be used with the trim for operation in either the IC environment or the non-IC environment.

Other systems, apparatus, methods, features, and advantages of the present invention will be or will become apparent to one with skill in the art upon examination of the following figures and detailed description. It is intended that all such additional systems, methods, features, and advantages be included within this description, be within the scope of the invention, and be protected by the accompanying claims.

BRIEF DESCRIPTION OF THE DRAWINGS

The accompanying drawings, which are incorporated in and constitute a part of this specification, illustrate an implementation of the present invention and, together with the description, serve to explain the advantages and principles of the invention. In the drawings.

DETAILED DESCRIPTION OF THE DRAWINGS

Reference will now be made in detail to an implementation consistent with the present invention as illustrated in the accompanying drawings. Wherever possible, the same reference numbers will be used throughout the drawings and the following description to refer to the same or like parts.

Figure 1:
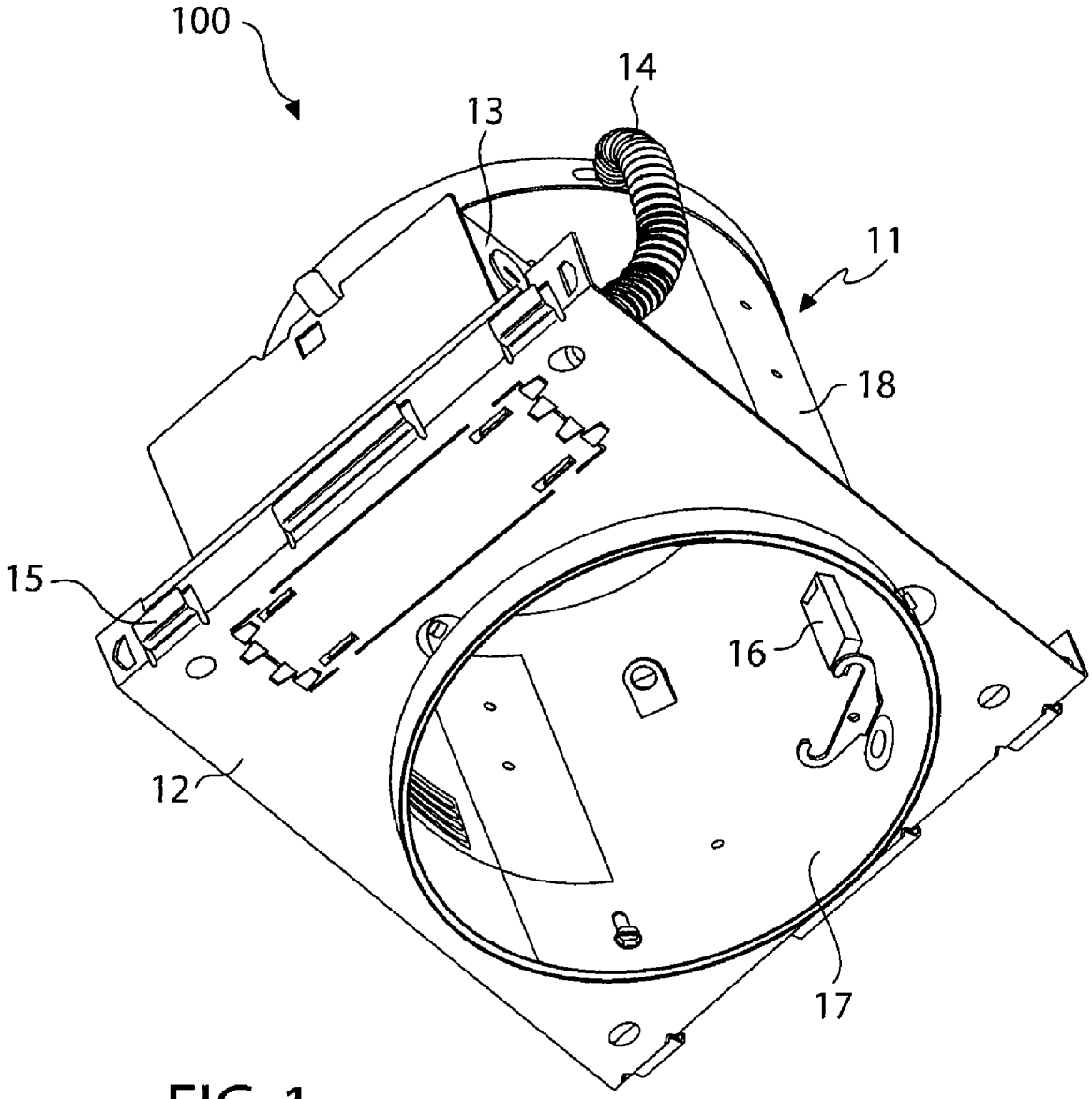
FIG. 1 is a perspective view of a light assembly having a light fixture in accordance with the present invention.

Referring to FIG. 1, one implementation of a lighting assembly 100 configured for installations in both IC and non-IC environments in accordance with the present invention is shown. The lighting assembly 100 comprises a light fixture 11 mounted on a pan 12. A conventional wire junction box 13 is mounted on the pan 12 and is connected to a lamp socket (not shown), which is typically mounted internally to the light fixture 11, by a wire conduit 14. The pan 12 includes hanger bar brackets 15 that slidably engage adjustable bar hangers or rails (not shown) used to mount or affix the pan 12 on a pair of ceiling joists or beams (not shown). A thermal protector unit 16 is affixed to an internal surface 17 of the fixture 11.

In FIG. 1, the light fixture 11 includes a can or lamp housing 18 having a cylindrical shape. However, the lamp housing 18 may have another shape, such that box-like, frusto-conical, hour glass, and the like. The housing 18 may be formed of a material having high heat or fire resistance properties, such as metal, ceramic, polymer, or any combination thereof. The housing 18 is preferably formed of aluminum or steel. This housing 18 is adapted for installations in either an IC environment or a non-IC environment when operating with proper lamping in accordance with safety and electric code requirements, such as UL standards and the like, when operating with proper lamping. To the extent necessary, the building and lighting industry standard UL 1598, as well as other appropriate safety standards, are incorporated by reference herein.

As stated above, in an IC installation the light fixture 11 may abut against the surrounding insulation or be within three inches from the surrounding insulation, but can not operate if an external surface temperature exceeds 90° Celsius (C.). While in a non-IC installation, the light fixture 11 needs to be positioned at least three inches from the surrounding insulation, and can not operate if an external surface temperature exceeds 150° Celsius (C.).

Figure 2A:
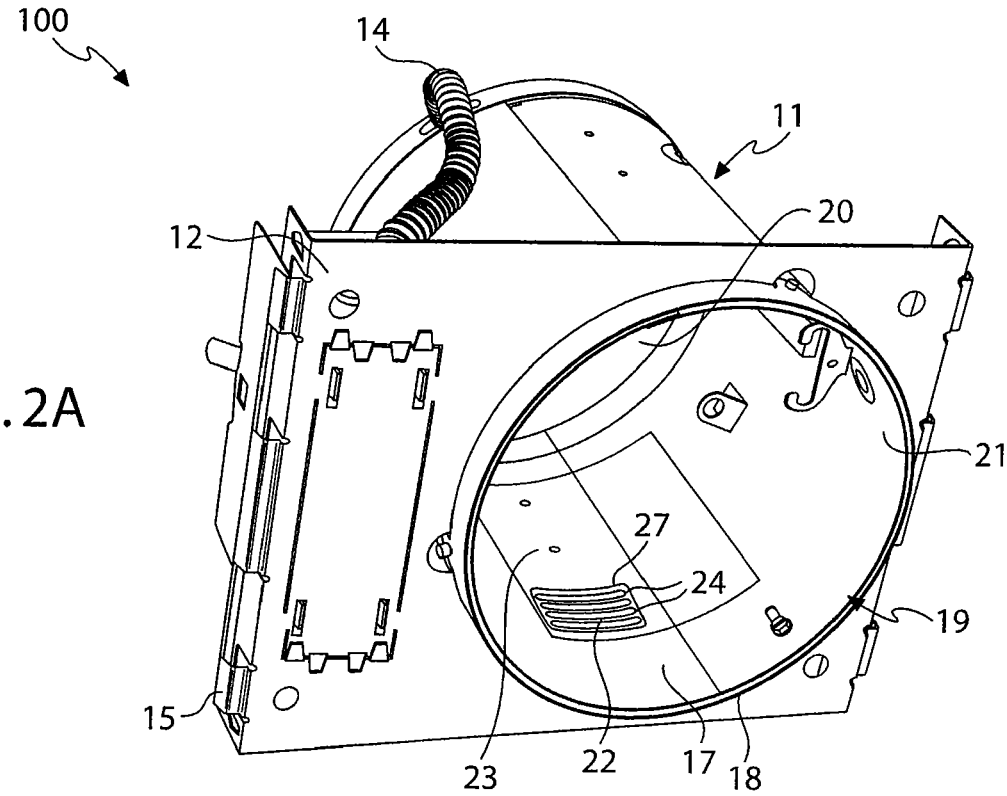
FIGS. 2A-B are two perspective views of the light assembly of FIG. 1, where the light fixture has a housing and a label disposed in relation to the housing in accordance with the present invention.

Now referring to FIG. 2A, the housing 18 has an open bottom end 19, a closed top end 20, and a wall 21 positioned therebetween and visible through the open end 19. The wall 21 is depicted as cylindrical; however the wall 21 may be one of a plurality of walls that define the shape of the housing 18. The housing 18 may be formed of one integral element or a plurality of sheet metal elements assembled and fastened together. The light fixture 11 is adapted to be installed so that the open bottom end 19 provides a light outlet for illuminating a room or area or space through an opening provided in a surface of the ceiling (not shown in the figures) or the other appropriate structure. The closed top end 20 provides support for an electric light socket (not shown in the figures) that is adapted to support and provide power to one of a plurality of lamps (not shown in the figures) installed in the socket. Typically, the electric socket is positioned concentrically with the open end bottom 18, but may be positioned at any other location within the light fixture 11 to at least partially illuminate the space below the open end 19 of the light fixture 11.

As shown in FIG. 2, the wall 21 defines an opening or aperture 22 having a size sufficient to enable an installer or user to determine whether the light fixture 11 is installed in an IC environment or a non-IC environment when looking through the aperture 22 via the open bottom end 19. That is, by looking through the aperture 22 the user is able to determine whether an external insulation (not shown in the figures) is located within three inches from the light fixture 11.

The aperture 22 may comprise a plurality of slots 24 arranged in proximity of each other so as to maximize a view of the external environment surrounding the housing 11. Further, the aperture 22 or each of the slots 24 may also be a louver having fixed slats extending outwardly from an outer surface 25 of the wall 21. As shown, the aperture 22 is positioned in the lower vertical half of the circular wall 21 and essentially halfway horizontally between the hanger bar brackets 15. Alternately, the aperture 22 may be positioned at any position on the wall 21 so long as a view of the external environment through the aperture 22 is not substantially obstructed by external elements, such as the wire junction box 13 and the wiring conduit 14.

In one implementation, the aperture 22 has a width that is no more than three sixteenth (3/16) of an inch, and an area that is no more than one and one half (1½) square inches in accordance with the UL 1571 standard requirements for installations in an IC environment as well as a non-IC environment.

Figure 2B:
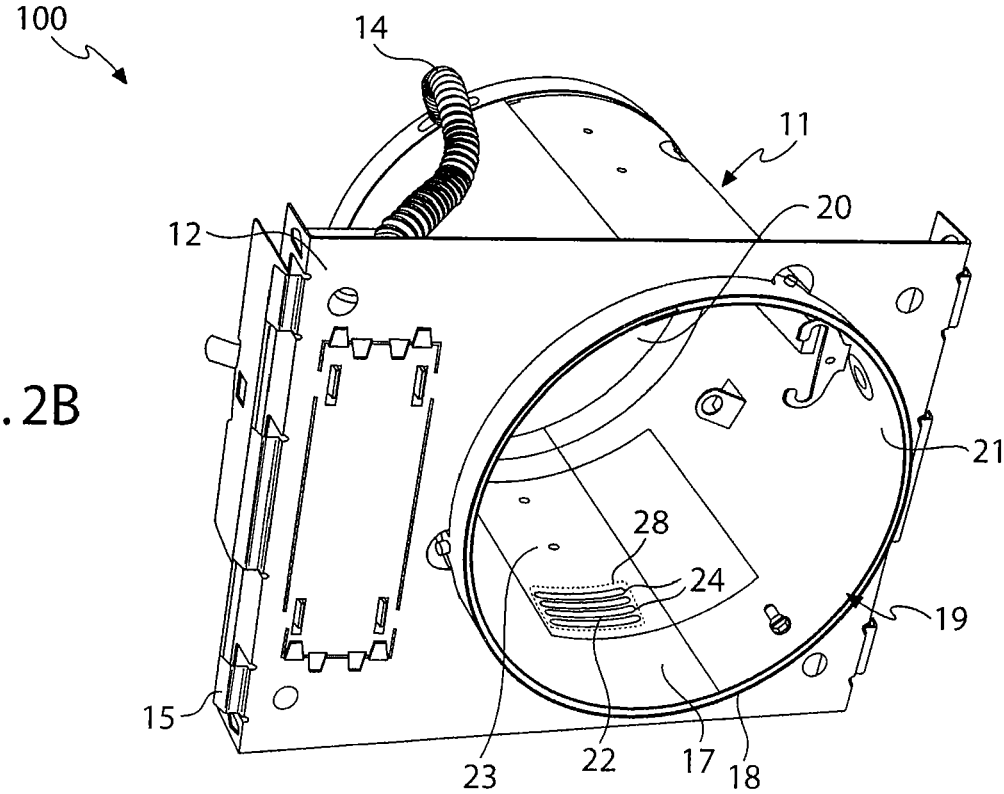
Figure 3:
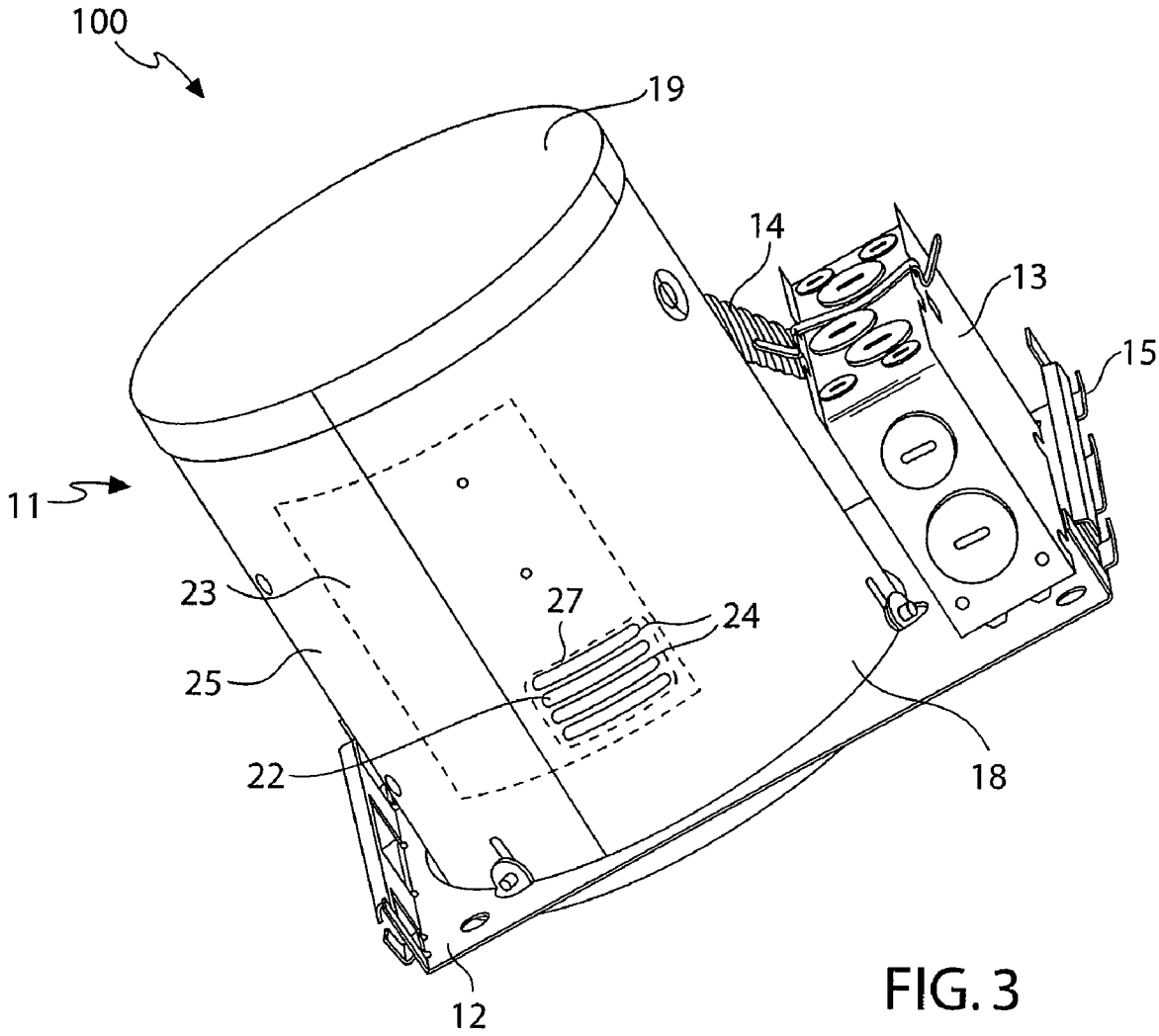
FIG. 3 is another perspective view of the lighting assembly in FIG. 1 illustrating an external wall of the housing defining an aperture.

As shown in FIGS. 2A-B and 3, the fixture 11 has a label 23, which may be affixed during manufacture or installation of the fixture 11 to the inside surface 17 of the wall 21. In one implementation shown in FIG. 2A, the label 23 may be provided with a cut-out 27 that is aligned with the aperture 22. Such alignment of the cut-out 27 and the aperture 22 enable the user to determine whether the fixture 11 is installed in an IC environment or a non-IC environment by looking or peering through the cut-out 27 via the open bottom end 19. In another implementation shown in FIG. 2B, the label 23 may have a transparent portion 28 that is adapted to be aligned with the aperture 22 such that the user is able to see through the transparent portion 28 and the aperture 22 to make a determination as to whether the light assembly 100 was installed in an IC environment or a non-IC environment.

Figure 4A:
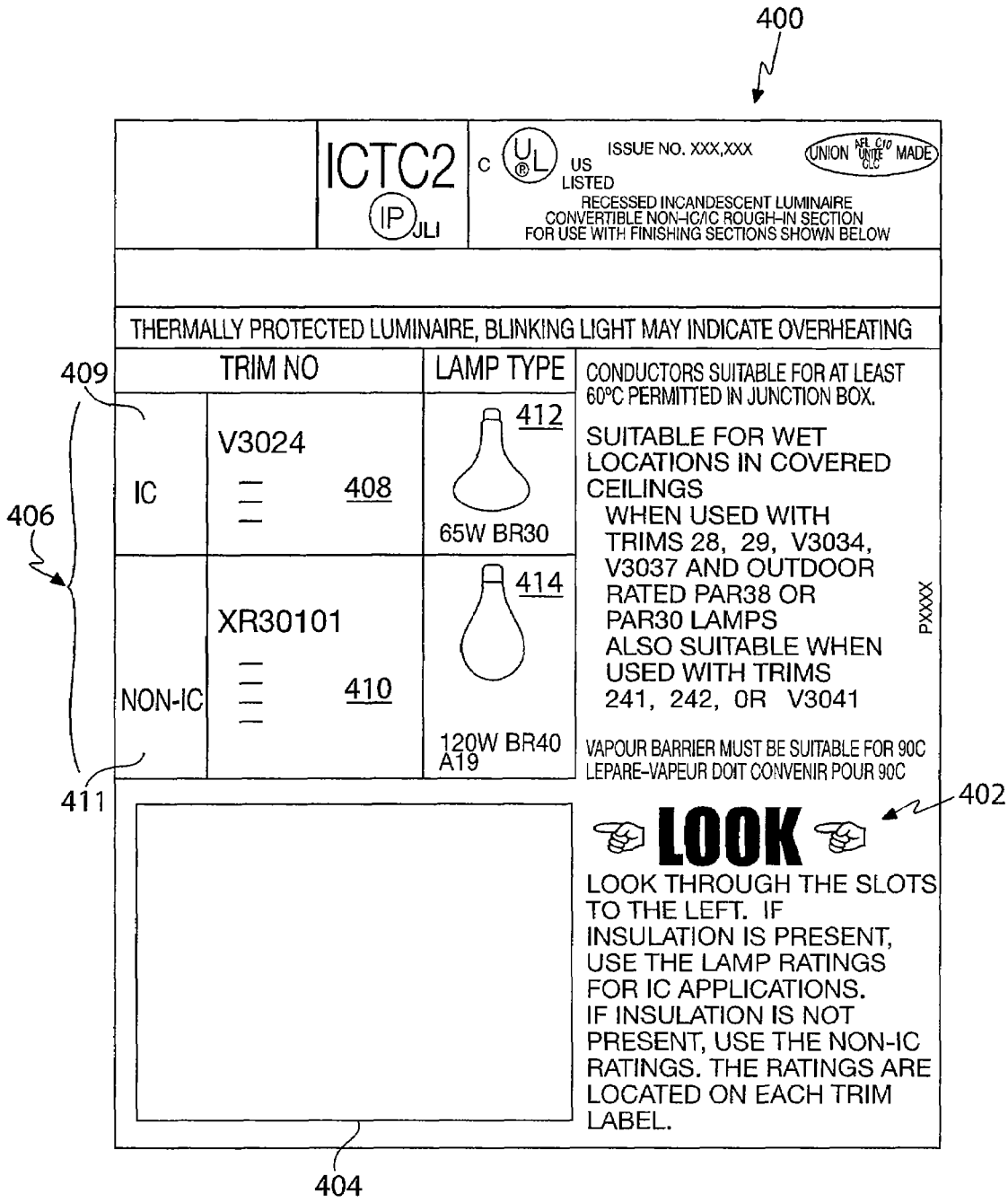
FIGS. 4A-4B illustrate two embodiments of the label of FIG. 2 in accordance with the present invention.
Figure 4B:
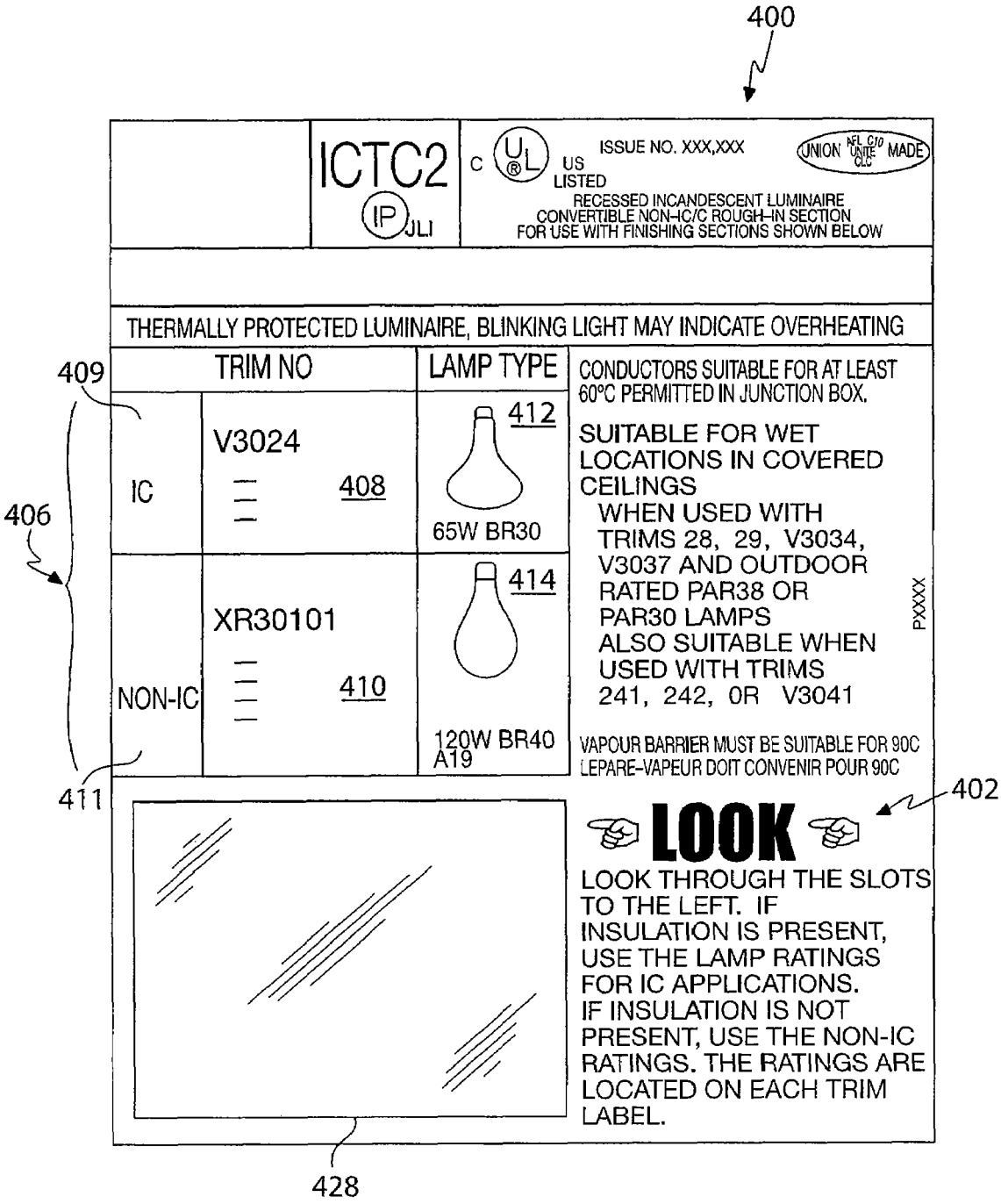

FIG. 4A depicts a label 400 suitable for use with the light fixture 11 in accordance with the present invention. The label 400 is consistent with the label 23 depicted in FIGS. 2A, 2B and 3 and has an indicia 402 signaling the user to look through a section 404 of the label 400 corresponding to the cut-out 27 to make a determination whether insulation is present or within a predetermined distance (e.g., three inches) of the light fixture 11, and instructing the user to make a lamp selection based on the determination. FIG. 4B depicts the label 400 with a transparent portion 428.

In the label implementation shown in FIGS. 4A and 4B, the label 400 includes a section 406 identifying a first plurality of trims 408 in association with an "IC" identifier 409 that reflect each of the trims 408 that are operatively configured to mate with and be used in the light fixture 11, when the light fixture 11 is installed in the IC environment. The section 406 also identifies a second plurality of trims 410, in association with an "non-IC" identifier 410 that reflect each of the trims 410 that are operatively configured to mate with and be used in the light fixture 11, when the light fixture 11 is installed in the non-IC environment.

Moreover, the section 406 of the label 400 further identifies the maximum lamp wattage permitted for use in an IC environment. The section 412 is physically associated with the IC identifier 409 to reflect that each of the indicated lamp selections is suitable when the light fixture 11 is installed in an IC environment. The section 406 further identifies a plurality of lamp selections 414 for use in a non-IC environment. These selections are physically associated with the non-IC identifier 411 to reflect that each of the lamp selections 414 is suitable, when the light fixture 11 is installed in the non-IC environment. Each of the lamp selections 412 and 414 may identify a lamp type (e.g., "BR 30") and a power limit or wattage (e.g., 65 watts or 120 watts) associated with the respective lamp selection.

In an alternate implementation, the first plurality of trims 408 and the first plurality of lamp selections 412 associated with the "IC" identifier 409 may be removed and replaced with an alternate indicia to instruct the user to use finishing sections (e.g., trims) and lamp selections labeled for the use with the fixture 11 once the user has determined (via aperture 22) that the light fixture 11 is installed in the IC environment. For example, the indicia replacing the identified trims 408 and lamp selections 412 in section 406 of the label 400 may read as follows: "For lamp selections for use with fixture 11 in an IC installation, see trims marked for use with the fixture 11 in IC installation."

Figure 5:
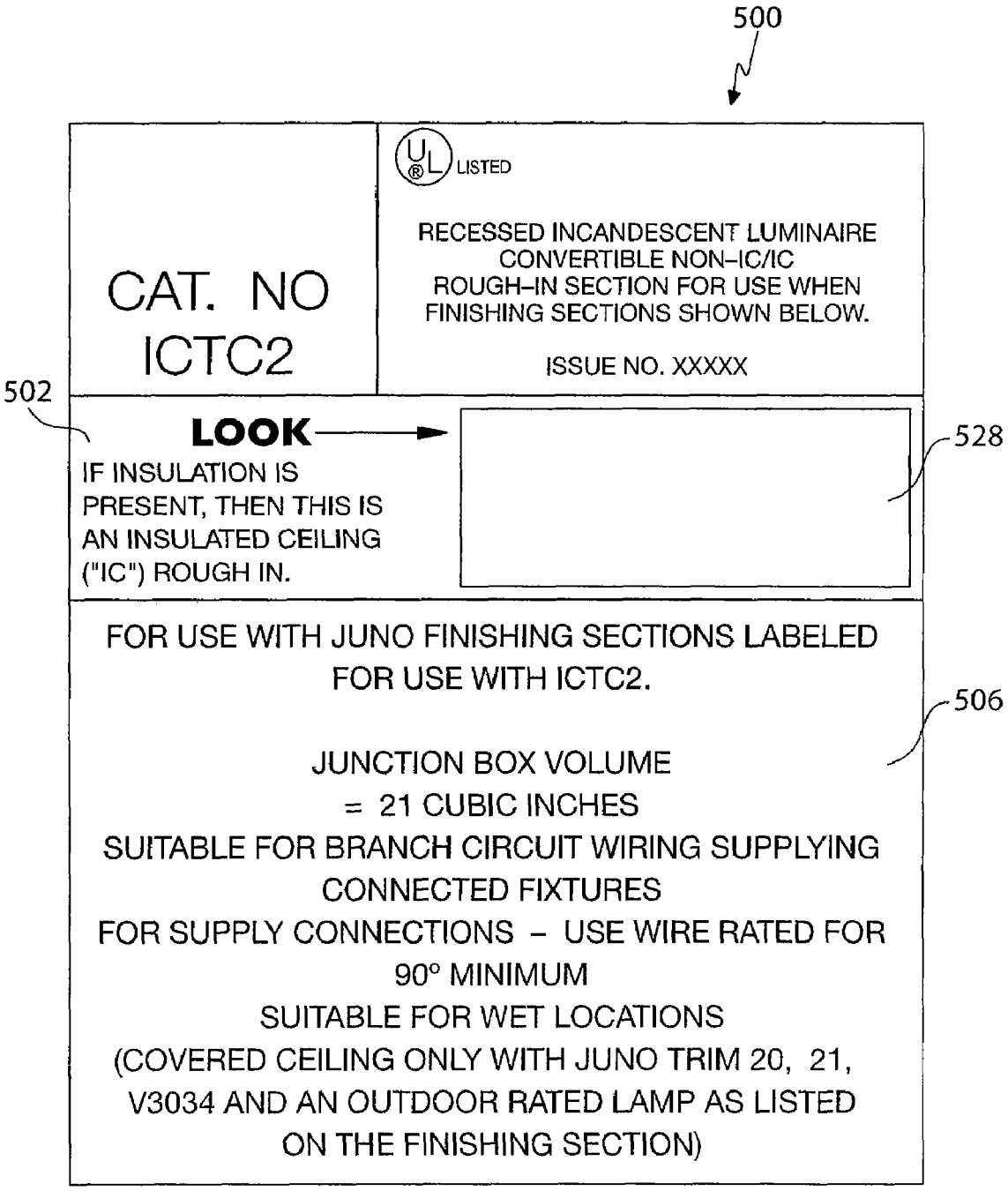
FIG. 5 illustrates another embodiment of the label of FIG. 2 in accordance with the present invention.

In another alternate implementation, the second plurality of trims 410 and the second plurality of lamp selections 414 associated with the "non-IC" identifier 411 may be removed and replaced with an alternate indicia to instruct the user to use finishing sections (e.g., trims) and lamp selections labeled for the use with the fixture 11 once the user has determined (via aperture 22) that the light fixture 11 is installed in the non-IC environment. For example, the indicia replacing the identified trims 410 and lamp selections 414 in section 406 of the label 400 may read as follows: "For lamp selections for use with fixture 11 in a non-IC installation, see trims marked for use with the fixture 11 in a non-IC installation." FIG. 5 depicts another label 500 suitable for use with the light fixture 11 in accordance with the present invention. The label 500 is consistent with the label 23 depicted in FIGS. 2A-B and 3 and has a first indicia 502 to signal the user to look through a section 528 of the label 500 corresponding to the transparent portion 28 to make a determination whether insulation is present or within a predetermined distance (e.g., three inches) of the light fixture 11, and instructing the user to make a lamp selection based on the determination. Rather than specify the trim model numbers that can be used in association with both installation situations, the label 500 includes a second indicia 506 instructing the user to use finishing sections, e.g., trims, labeled for the use with the installation environment the user has determined by noting whether insulation is within the predetermined distance from the light fixture 11.

Figure 6:
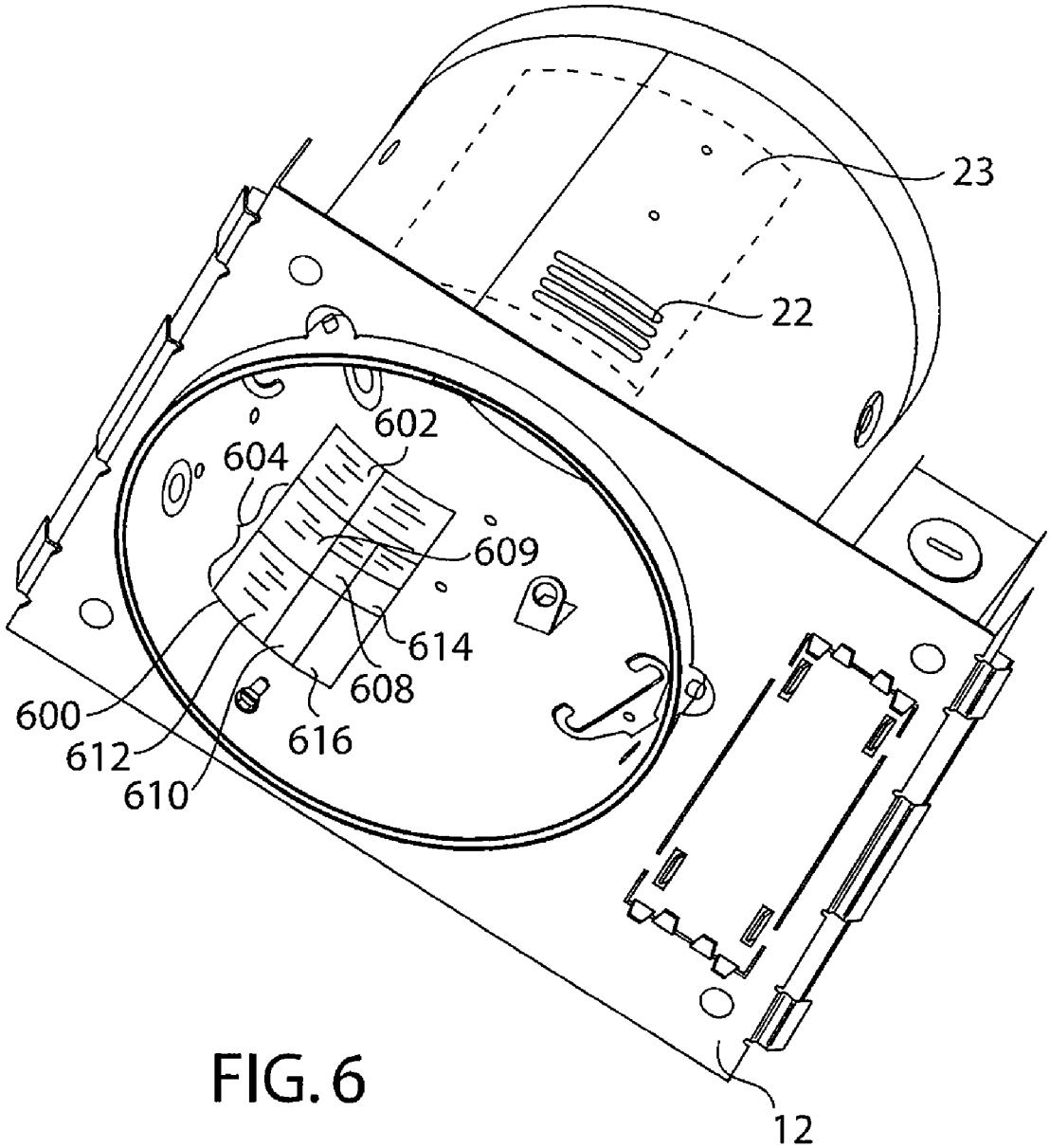
FIG. 6 illustrates another perspective view of the lighting assembly in FIG. 1 illustrating another embodiment of the label in relation to the aperture in accordance with the present invention.

FIG. 6 depicts another label 600 suitable for use with the light fixture 11 in accordance with the present invention. The label 600 may be positioned at another location on the wall 21 that is distinct from and/or does not overlap with the aperture 22 or the label 23 as shown in FIG. 6. In this implementation, the label 600 is visible through the open end 19 but does not define or otherwise circumscribe the aperture 22. The label 600 includes a first indicia 602 instructing the user to determine by peering through the separately positioned aperture 22 whether insulation is present external to the housing wall 21 less than a predetermined distance from the light fixture 18.

Moreover, the label 600 includes a section 604 that identifies a first plurality of trims 608 in association with an "IC" identifier 609 that reflect each of the trims 608 that are operatively configured to mate with the light fixture 11 when the fixture is installed in an IC environment. The section 604 also identifies a second plurality of trims 610, in association with "non-IC" identifier 612 that reflect each of the trims 610 that are operatively configured to mate with the light fixture 11 when the fixture is installed in a non-IC environment.

Moreover, the section 604 of the label 600 identifies a first plurality of lamp selections 614 in association with the IC identifier 609 to reflect that each of the selections 614 suitable when the light fixture 11 is installed in an IC environment. The section 604 further identifies a second plurality of lamp selections 616 in association with the non-IC identifier 612 to reflect that each of the lamp selections 616 suitable when the light fixture 11 is installed in a non-IC environment. Each of the lamp selections 614 and 616 may identify a lamp type (e.g., "BR 30") and a power limit or wattage (e.g., 65 watts or 120 watts) associated with the respective lamp selection.

Figure 7:
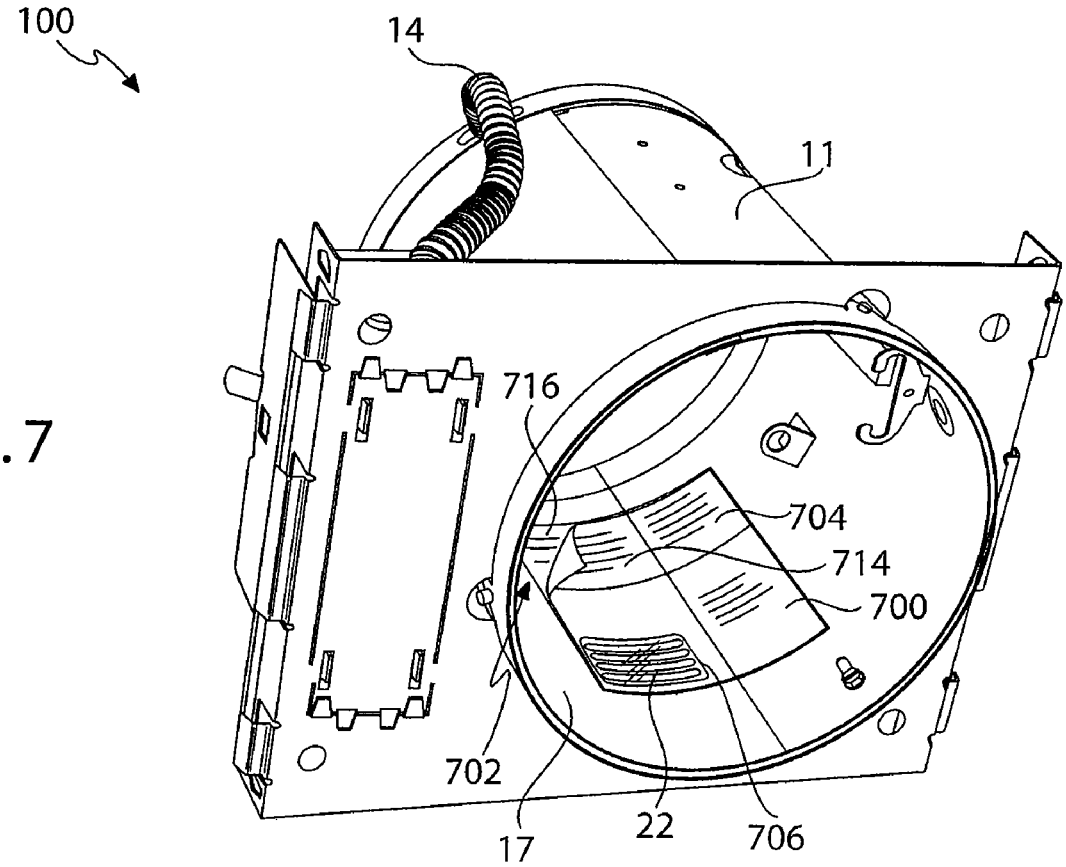
FIG. 7 illustrates another perspective view of the lighting assembly in FIG. 1 illustrating two overlapping labels in relation to the aperture in accordance with the present invention.

In the implementation shown in FIG. 7, the fixture 11 includes two separate labels 700 and 702 (collectively corresponding to label 23), which may be removably affixed during manufacture or installation to the inside surface 17 of the wall 21. The first 700 of the two may have indicia 704 having instructions for IC installations of the light assembly 100, and a second label 702 having indicia (obscured by the first label 700 in FIG. 7) having instructions for non-IC installations of the light assembly 100. The first label 700 may be positioned over the second label 702, and the indicia 704 instructing the installer or user to remove the first label 700 to expose the second 702 if the user determines, by looking through the aperture 22, that insulation is present or within a predetermined distance from the light fixture 11. The first label defines a cut-out or transparent portion 706, and the second label 702 defines a second cut-out or transparent portion (obscured by the first label 700) may be positioned such that their respective cut-outs or transparent portions 706 are substantially aligned with the aperture 22.

Accordingly, the first label 700 may include indicia 714 identifying a first set of lamp selections (e.g., lamp types associated with power limits or ratings) and trims for use in the fixture 11 when installed in an IC environment, and the second label 702 may include indicia 716 identifying a second set of lamp selections and trims for use with the fixture 11 when installed in a non-IC environment. Moreover, the first label 700 may include another indicia identifying trims for installation in a non-IC environment. The non-IC trim may include a label having indicia identifying a corresponding set of lamp selections (e.g., lamp types associated with power limits or ratings) for use when the fixture is installed in a non-IC environment. The second label 702 may also include another indicia identifying trims for installation in an IC environment. The IC trim may include a label having indicia identifying a corresponding set of lamp selections (e.g., lamp types associated with power limits or ratings) for use when the fixture is installed in an IC environment.

It is understood that the first label 700 may be adhesively backed so as to be peelably removed away from the housing 18 to expose the second label 702. It is further understood that the first label 700, having instructions for the IC installation of the light assembly 100, may be disposed under the second label 702. In this implementation, the second label 702 may have indicia corresponding to indicia 704 instructing the user to remove the second label 702 if the user determines that if the user determines, by looking through the aperture 22, that insulation is present within a predetermined distance from the light fixture 11.

Figure 8:
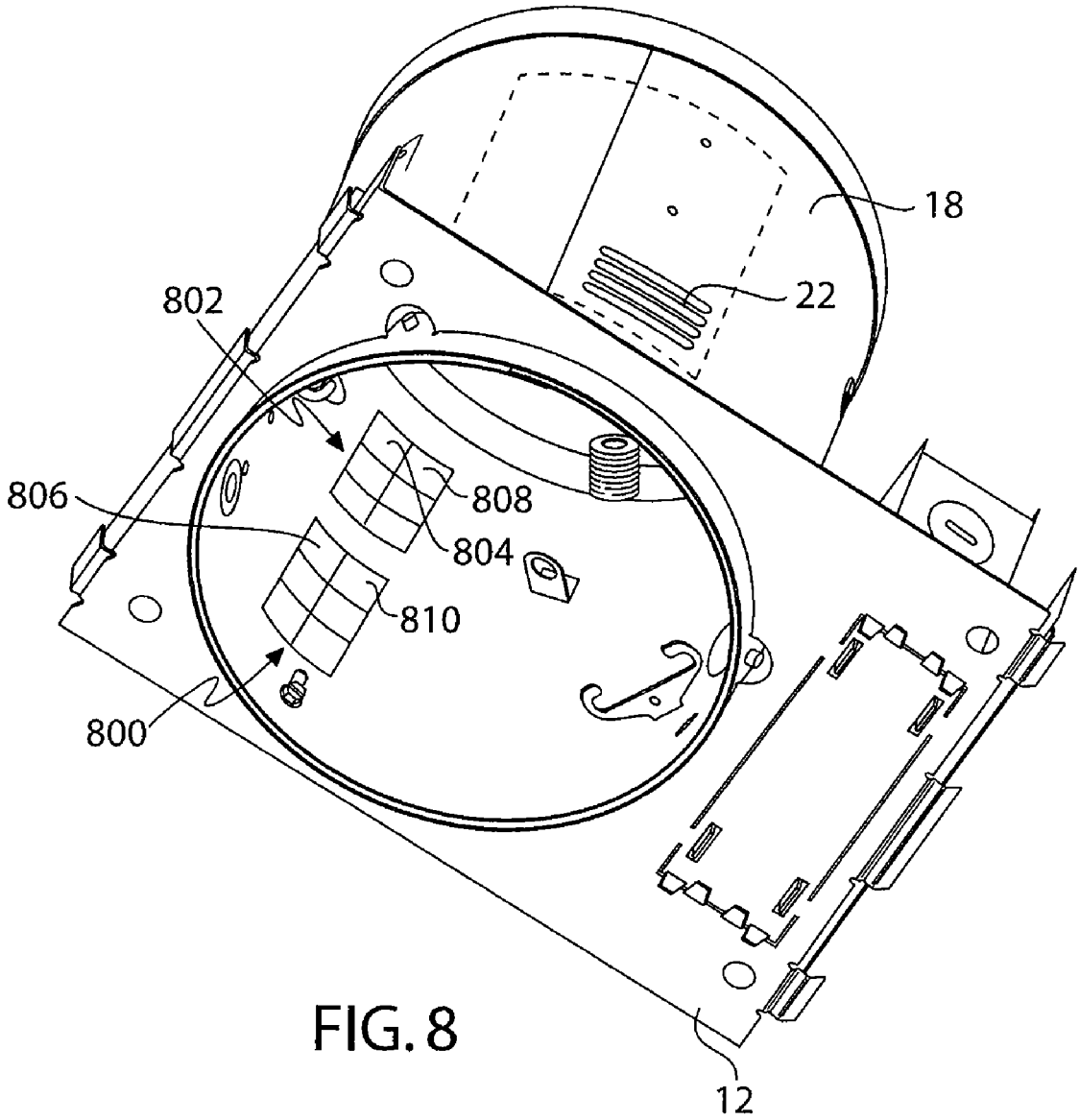
FIG. 8 illustrates another perspective view of the lighting assembly in FIG. 1 illustrating two non-overlapping labels in relation to the aperture in accordance with the present invention.

In the implementation depicted in FIG. 8, the fixture 11 includes two non-overlapping labels 800 and 802 (collectively corresponding to the label 23), which may be removably affixed during manufacture or installation to the internal surface 17 of the housing 18. As shown in FIG. 8, both labels 800 and 802 include indicia 804 and 806, respectively, to instruct the installer or user to determine by peering through the aperture 22 whether insulation is present within a predetermined distance (e.g., three inches) from the external surface 25 of the fixture 11. The labels 800 and 802 also include indicia 808 and 810 instructing the user to remove one of the two labels 800 and 802 that does not list trim types and lamp types and wattages corresponding to the determined installation environment of the light fixture 11. In this implementation, once the fixture 11 has been installed, the installer needs only to ensure that the remaining label is visible on the wall 21. In this non-overlapping label arrangement, neither one of the labels 802 and 804 needs to define a corresponding cut-out 27 or transparent portion 28.

Figure 9:
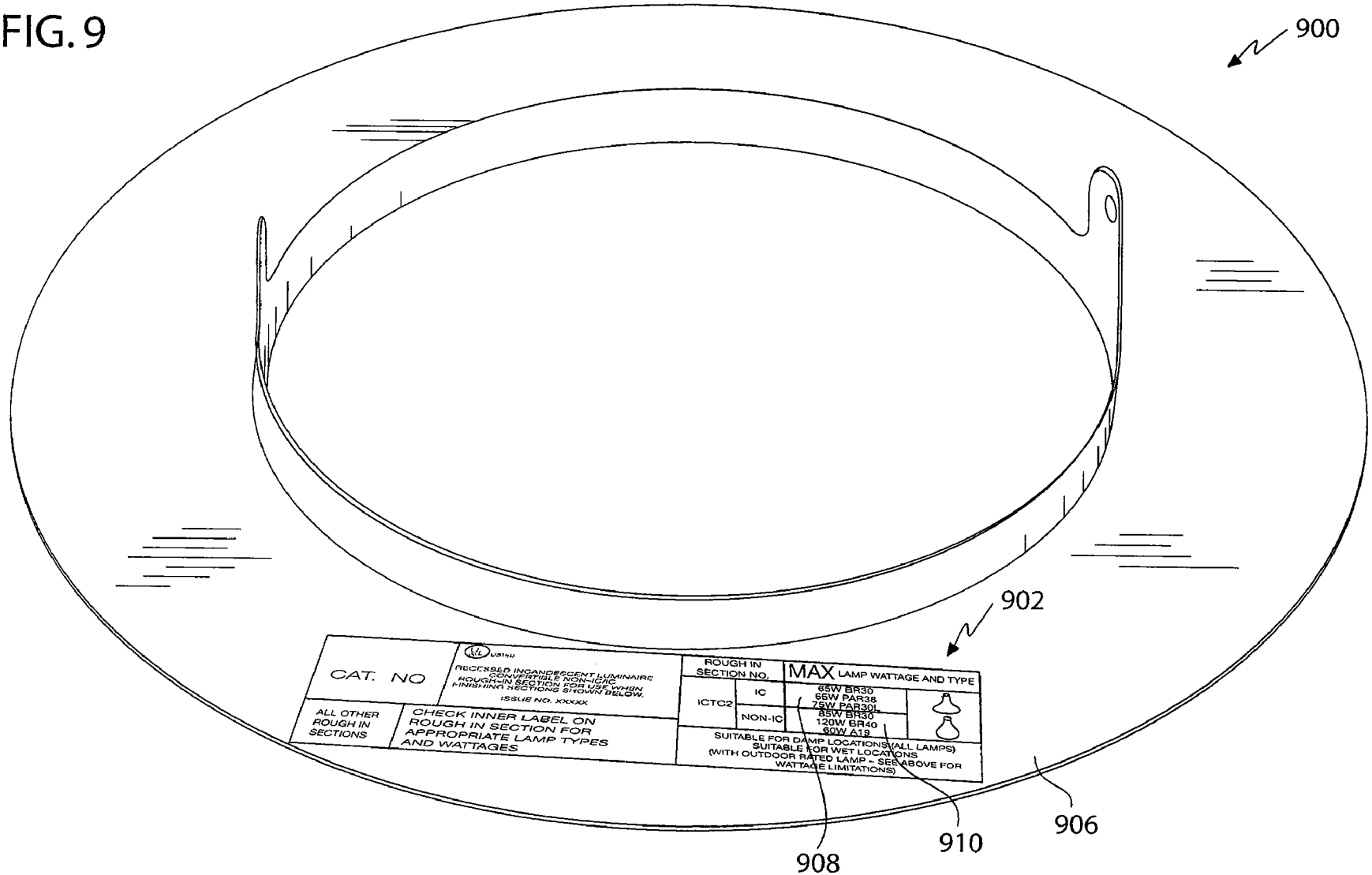
FIG. 9 is a perspective view of an exemplary trim suitable for use in the light assembly of FIG. 1.

Now referring to FIG. 9, an exemplary trim 900 suitable for use with the light assembly 100 is shown. The trim 900, which comprises an annular shape, is adapted to be removably engaged to the housing 18 via one or more torsion springs (not shown) or other means for retaining the trim 900 relative to a ceiling or structure (not shown in the figures) and below the open bottom end 19 of the housing 18. The trim 900 is adapted for mating with the fixture 11 after installation in the ceiling or structure, and is shaped and sized so as to cover a potential gap (not shown in the figures) between the housing 18 and the ceiling or structure. The trim 900 includes a label 902 affixed on a flange 906 or other portion of the trim 900. The label 902 may include a first indicia 908 that identifies a first plurality of lamp selections (e.g., lamp type or types and associated power limit or wattages) that may be installed in the housing 18 of the lighting assembly 100 when the lighting assembly 100 is installed in an IC environment, and a second indicia 910 that identifies a second plurality of lamp selections that may be installed in the housing 18 of the lighting assembly 100 when the lighting assembly 100 is installed in a non-IC environment.

Accordingly, the housing label 400 of FIG. 4 may identify the trim 900 designated for mating with the fixture 11, and the trim 900 may identify the plurality of lamp selections that may be suitable for use with the trim 900 when installed with the light assembly 100 in either the IC environment or the non-IC environment.

Figure 10:
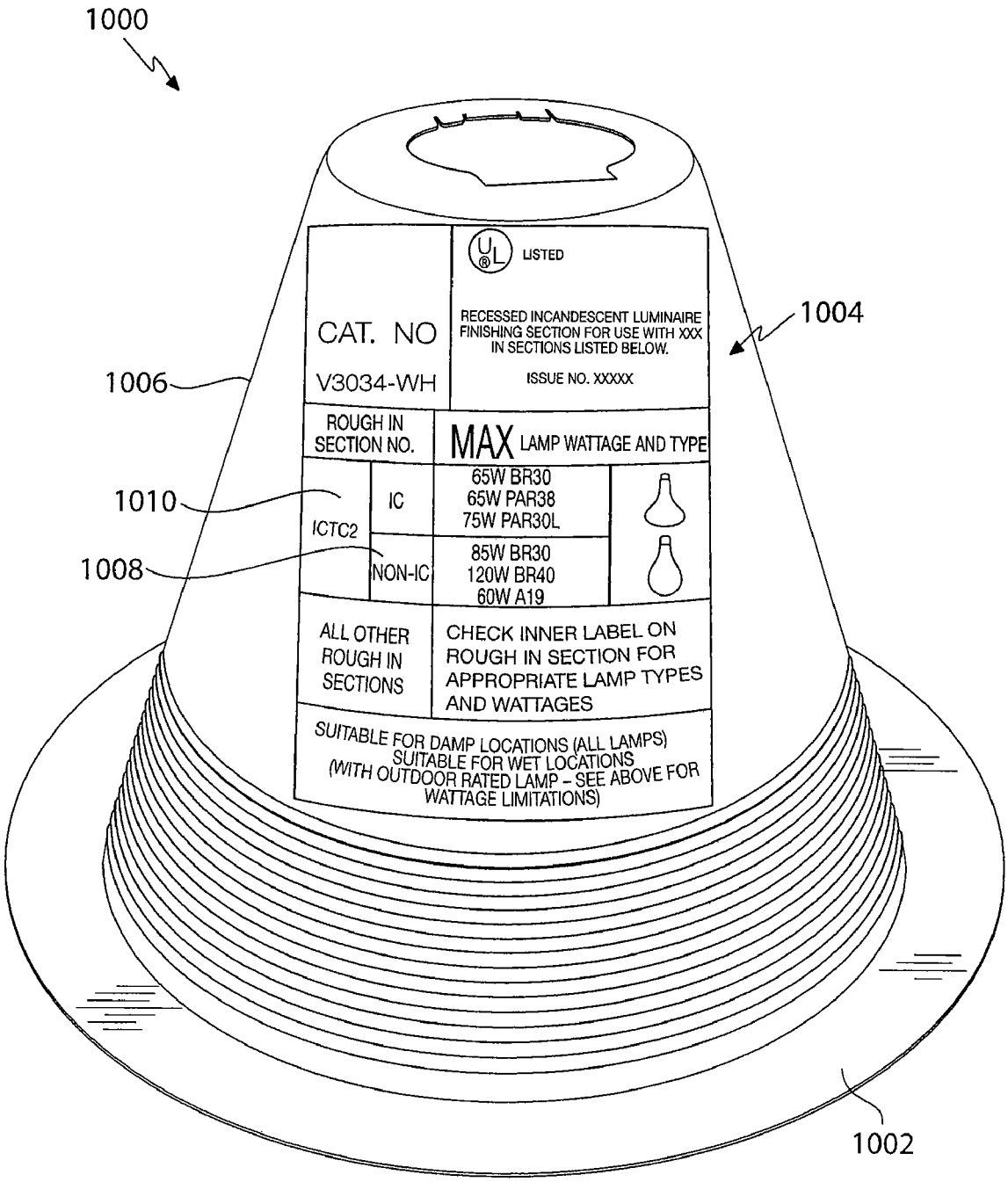
FIG. 10 is a perspective view of another exemplary trim suitable for use in the light assembly of FIG. 1 in the light assembly of FIG. 1 in accordance with the present invention.

Now referring to FIG. 10, another exemplary trim 1000 which is suitable for use in the light assembly 100 is shown. The trim 1000, which is depicted with a cone shape, comprises an integral trim ring 1002. This trim 1000 is adapted to be introduced through the bottom open end 19 and removably engaged to the top closed end 20 of the light assembly 100 housing 18. This trim 1000 may be made from a fire resistant material that substantially reduces the heat from a lamp installed in the light socket from reaching an area external to the housing 18. Further, the trim ring 1002 is shaped and sized so as to cover a potential gap (not shown in the figures) between the housing 18 and a ceiling or structure above or behind which the housing 18 is installed. In accordance with the invention, the trim 1000 includes a label 1004, which may be affixed during manufacture or installation and positioned on an external surface 1006 of the trim 1000. Consistent with the label 902 of the trim 900, the label 1004 includes a first indicia 1008 that identifies a first plurality of lamp selections that may be installed in the housing 18 of the lighting assembly 100 when the lighting assembly 100 is installed in an IC environment, and a second indicia 1010 that identifies a second plurality of lamp type or types and wattages that may be installed in the housing 18 of the lighting assembly 100 when the lighting assembly 100 is installed in a non-IC environment.

Returning to FIG. 1, the thermal protector unit 16 is affixed to the internal surface 17 of the housing 18 for improper lamping protection. Based on the UL 1598 standard guidelines, the thermal protector unit 16 may also be located on an outer surface of the closed top end 20 within 1½ inches from an axial center of the housing 18, and be detachably secured to the housing 18 via a galvanized steel bracket. Alternately, the thermal protector unit 16 may be positioned on an inside top surface of the housing 18 within 1½ inches from the axial center, and secured within a galvanized steel cover (not shown in the figures) which may be securely affixed to the housing 18.

The thermal protector unit 16 includes a thermistor (not shown) for sensing a temperature near the internal housing surface 17 of the housing 18 and then interrupting power to the light socket (and any lamp installed therein) when the sensed temperature reaches approximately 105° C.+/−5° C. The light assembly 100 may be configured such that, under IC installation conditions, the sensed operating temperature of the internal surface 17 of the housing 18 may not exceed 90° C. when the lamp wattage is a maximum wattage indicated on the label 74 of the trim 700, which was designated for use with the recessed fixture 11, for example. Thus, during operations the thermal protector unit 16 may allow the fixture 11 to meet the UL 1598 requirement of 90° C. maximum housing surface temperature for an IC rated fixture.

Moreover, during operation the temperature of the external surface of the housing 18, and thus that of the proposed fixture 11, may not exceed the 150° C. UL 1598 maximum temperature requirement for the non-IC environment before the thermal protector unit 16 senses an internal temperature of 105° C.+/−5° C. and interrupts power to the installed lamp. Thus, the thermal protector unit 16, as configured to be used with the proposed fixture 11, may sense only one predetermined temperature before interrupting power regardless of whether the fixture 11 is installed in an IC environment or a non-IC environment.

The thermal protector unit 6 may be recognized regulating equipment, such as the protector unit designated "7AM029A5" and manufactured by Texas Instruments Inc. (TI). This TI unit is rated at 5.5 Amperes, 120 Volts, and 600 Watts, and has an opening temperature of 110° C. Alternately, the thermal protector unit 6 may be any other manufactured unit that is configured to sense the external housing temperature of the housing 18 and interrupt power when this temperature reaches the predetermined temperature of 105° C.+/−5° C.

While various embodiments of the present invention have been described, it will be apparent to those of skill in the art that many more embodiments and implementations are possible that are within the scope of this invention. Accordingly, the present invention is not to be restricted except in light of the attached claims and their equivalents.

The invention claimed is:

1. A light assembly for installation in one of an insulation capable (IC) environment and a non-insulation capable (non-IC) environment, the light assembly comprising:

a light fixture including a housing having an open end and a wall visible through the open end, the wall defining an aperture having a size sufficient for determining whether insulation is within a predetermined distance of the light fixture; and at least one label having an indicia signaling a user to use the aperture to make a determination whether insulation is within the predetermined distance of the light fixture and instructing the user to make a lamp selection based on the determination.

2. The lighting assembly of claim 1, wherein the at least one label comprises a cut-out and is positioned on an internal surface of the housing so that the cut-out is aligned with the aperture.

3. The lighting assembly of claim 1, wherein the at least one label includes a transparent portion and is positioned on an internal surface of the housing so that the transparent portion is aligned with the aperture.

4. The lighting assembly of claim 1, wherein the at least one label instructs the user to reference a second label associated with the light fixture to make the lamp selection.

5. The lighting assembly of claim 4, wherein the second label identifies a first plurality of lamp selections, each of the first plurality of lamp selections being adapted to operate in the light fixture at or below a first power level when installed in the IC environment, and a second plurality of lamp selections, each of the second plurality of lamp selections being adapted to operate in the light fixture at or below a second power level when installed in the non-IC environment.

6. The lighting assembly of claim 1, wherein the indicia comprises instructions for selecting a trim based on the insulation determination.

7. The lighting assembly of claim 1, wherein the at least one label identifies a first plurality of lamp selections, each of the first plurality of lamp selections being adapted to operate in the light fixture at or below a first power level when installed in the IC environment, and a second plurality of lamp selections, each of the second plurality of lamp selections being adapted to operate in the light fixture at or below a second power level when installed in the non-IC environment.

8. The lighting assembly of claim 1, wherein the at least one label comprises a first label positioned over a second label, the first label identifying a first plurality of lamp selections, each of the first plurality of lamp selections being adapted to operate in the light fixture at or below a first power level when installed in the IC environment, the second label identifying a second plurality of lamp selections, each of the second plurality of lamp selections being adapted to operate in the light fixture at or below a second power level when installed in the non-IC environment, and the first label having instructions to the user to remove the first label if the light fixture is determined to be installed in the non-IC environment to expose the second label.

9. The lighting assembly of claim 8, wherein the first label has instructions to the user to use a trim adapted to mate with the light fixture, the trim having another label identifying the second plurality of lamp selections.

10. The lighting assembly of claim 8, wherein the second label has instructions to the user to use a trim adapted to mate with the light fixture, the trim having another label identifying the first plurality of lamp selections.

11. The lighting assembly of claim 8, wherein the first label and the second label each comprises a cut-out, and both the first and second labels are positioned such that the cut-out of the first label and the cut-out of the second label are substantially aligned with the aperture.

12. The lighting assembly of claim 8, wherein the first label and the second label each comprises a transparent portion, and both the first and second labels are positioned such that the transparent portion of the first label and the transparent portion of the second label are substantially aligned with the aperture.

13. The lighting assembly of claim 1, wherein the at least one label comprises a first label positioned under a second label, the first label having identifying a first plurality of lamp selections, each of the first plurality of lamp selections being adapted to operate in the light fixture at or below a first power level when installed in the IC environment, the second label having identifying a second plurality of lamp selections, each of the second plurality of lamp selections being adapted to operate in the light fixture at or below a second power level when installed in the non-IC environment, and the first label having instructions to the user to remove the second label if the light fixture is determined to be installed in the IC environment to expose the first label.

14. The lighting assembly of claim 1, wherein the at least one label comprises a first label and a second label, each being removably affixed to the wall of the housing such that the first and second label do not overlap, the first label having identifying a first plurality of lamp selections, each of the first plurality of lamp selections being adapted to operate in the light fixture at or below a first power level when installed in the IC environment, and the second label having identifying a second plurality of lamp selections, each of the second plurality of lamp selections being adapted to operate in the light fixture at or below a second power level when installed in the non-IC environment, and at least one of the first and second labels having instructions for the user to remove one of the first and second labels that does not correspond to the determined installation of the lighting assembly.

15. The lighting assembly of claim 1, further comprising a thermal protector unit operable to sense a temperature near an internal surface of the housing and to interrupt power to the selected lamp installed in the housing when the sensed temperature reaches a predetermined value.

16. The lighting assembly of claim 15, wherein the thermal protector unit is disposed on an external surface of the housing.

17. The lighting assembly of claim 15, wherein the thermal protector unit is disposed on an internal surface of the housing.

18. The lighting assembly of claim 15, wherein the predetermined temperature is about 105 degree C. +/−5 degree C.

19. A light assembly for installation in one of an insulation capable (IC) environment and a non-insulation capable (non-IC) environment, the light assembly comprising:

a pan support;

a junction box;

a light fixture mounted on the pan support and connected to the junction box, and having a housing having an open end and a wall visible through the open end, the wall defining an aperture having a size sufficient for determining whether insulation is within a predetermined distance of the light fixture;

at least one label having an indicia signaling a user to use the aperture to make a determination whether insulation is within the predetermined distance of the light fixture and instructing the user to make a lamp selection based on the determination; and a thermal protector unit positioned on the housing, the thermal protector unit being operable to sense a temperature near an internal surface of the housing and to interrupt power to the selected lamp installed in the housing when the sensed temperature reaches a predetermined value.

20. The lighting assembly of claim 19, wherein the at least one label comprises a cut-out and is positioned on an internal surface of the housing so that the cut-out is aligned with the aperture.

21. The lighting assembly of claim 19, wherein the at least one label comprises a transparent portion and is positioned on an internal surface of the housing so that the transparent portion is aligned with the aperture.

22. The lighting assembly of claim 19, wherein the at least one label instructs the user to reference a second label associated with the light fixture to make the lamp selection.

23. The lighting assembly of claim 22, wherein the second label identifies a first plurality of lamp selections, each of the first plurality of lamp selections being adapted to operate in the light fixture at or below a first power level when installed in the IC environment, and a second plurality of lamp selections, each of the second plurality of lamp selections being adapted to operate in the light fixture at or below a second power, level when installed in the non-IC environment.

24. The lighting assembly of claim 19, wherein the at least one label comprises a first label positioned over a second label, the first label having identifying a first plurality of lamp selections, each of the first plurality of lamp selections being adapted to operate in the light fixture at or below a first power level when installed in the IC environment, the second label having identifying a second plurality of lamp selections, each of the second plurality of lamp selections being adapted to operate in the light fixture at or below a second power level when installed in the non-IC environment, and the first label having instructions to the user to remove the first label if the light fixture is determined to be installed in the non-IC environment to expose the second label.

25. The lighting assembly of claim 24, wherein the first label and the second label each comprises a cut-out, and both the first and second labels are positioned such that the cut-out of the first label and the cut-out of the second label are substantially aligned with the aperture.

26. The lighting assembly of claim 24, wherein the first label and the second label each comprises a transparent portion, and both the first and second labels are positioned such that the transparent portion of the first label and the transparent portion of the second label are substantially aligned with the aperture.

27. The lighting assembly of claim 19, wherein the at least one label comprises a first label positioned under a second label, the first label having identifying a first plurality of lamp selections, each of the first plurality of lamp selections being adapted to operate in the light fixture at or below a first power level when installed in the IC environment, the second label having identifying a second plurality of lamp selections, each of the second plurality of lamp selections being adapted to operate in the light fixture at or below a second power level when installed in the non-IC environment, and the first label having instructions to the user to remove the second label if the light fixture is determined to be installed in the IC environment to expose the first label.

28. The lighting assembly of claim 19, wherein the at least one label comprises a first label and a second label, each being removably affixed to the wall of the housing such that the first and second label do not overlap, a first plurality of lamp selections, each of the first plurality of lamp selections being adapted to operate in the light fixture at or below a first power level when installed in the IC environment, and the second label having identifying a second plurality of lamp selections, each of the second plurality of lamp selections being adapted to operate in the light fixture at or below a second power level when installed in the non-IC environment, and at least one of the first and second labels having instructions for the user to remove one of the first and second labels that does not correspond to the determined installation of the lighting assembly.

29. A light assembly for installation in one of an insulation capable (IC) environment and a non-insulation capable (non-IC) environment, the light assembly comprising:

a light fixture including a housing having an open end and a wall visible through the open end, the wall defining an aperture having a size sufficient for determining whether insulation is within a predetermined distance of the light fixture;

at least one label having an indicia signaling a user to use the aperture to make a determination whether insulation is within the predetermined distance of the light fixture; and a trim adapted to mate with the light fixture, the trim including another label identifying a plurality of lamps, wherein the at least one label instructs the user to reference the other label on the trim to select one of the lamps based on the determination.

30. The lighting assembly of claim 29, wherein the plurality of lamps includes a first plurality of lamps and a second plurality of lamps, and the other label identifies the first plurality of lamps as being adapted to operate in the light fixture when installed in the IC environment and identifies the second plurality of lamps as being adapted to operate in the light fixture when installed in the non-IC environment.

31. The lighting assembly of claim 29, wherein each lamp selection comprises a respective lamp type.

32. The lighting assembly of claim 29, wherein each lamp selection comprises a power limit associated with the lamp selection.

33. A trim for mating with a light fixture in a light assembly, the light assembly being operatively configured for installation in one of an insulation capable (IC) environment and a non-insulation capable (non-IC) environment, the light fixture including a housing having an open end and a wall visible through the open end, the wall defining an aperture having a size sufficient for determining whether insulation is within a predetermined distance of the light fixture, the light fixture further including at least one label having an indicia signaling a user to use the aperture to make a determination whether insulation is within the predetermined distance of the light fixture and instructing the user to reference the trim to make a lamp selection based on the determination, the trim comprising:

another label identifying a first plurality of lamp selections, each of the first plurality of lamp selections being adapted to operate in the light fixture at or below a first power level when installed in the IC environment, and a second plurality of lamp selections, each of the second plurality of lamp selections being adapted to operate in the light fixture at or below a second power level when installed in the non-IC environment.

* * * * *